US011125542B2

(12) United States Patent
Motz

(10) Patent No.: US 11,125,542 B2
(45) Date of Patent: Sep. 21, 2021

(54) REAR DEPLOYING BROADHEAD

(71) Applicant: Troy Allen Motz, Lawndale, NC (US)

(72) Inventor: Troy Allen Motz, Lawndale, NC (US)

( * ) Notice: Subject to any disclaimer, the term of this patent is extended or adjusted under 35 U.S.C. 154(b) by 0 days.

(21) Appl. No.: 16/298,133

(22) Filed: Mar. 11, 2019

(65) Prior Publication Data

US 2019/0277607 A1 Sep. 12, 2019

Related U.S. Application Data

(60) Provisional application No. 62/641,604, filed on Mar. 12, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 2,859,970 A * 11/1958 Doonan ..... F42B 6/08 473/583
2,993,697 A * 7/1961 Urban ..... F42B 6/08 473/583
4,504,063 A * 3/1985 LeBus ..... F42B 6/08 473/584
4,579,348 A * 4/1986 Jones ..... F42B 6/08 473/583
4,932,671 A * 6/1990 Anderson, Jr. ..... F42B 6/08 473/583
4,973,060 A * 11/1990 Herzing ..... F42B 6/08 473/583
4,976,443 A * 12/1990 DeLucia ..... F42B 6/08 473/583
4,998,738 A * 3/1991 Puckett ..... F42B 6/08 473/583
5,066,021 A * 11/1991 DeLucia ..... F42B 6/08 473/583
5,082,292 A * 1/1992 Puckett ..... F42B 6/08 473/583
5,090,709 A 2/1992 Johnson
5,100,143 A * 3/1992 Puckett ..... F42B 6/08 473/583
5,102,147 A * 4/1992 Szeluga ..... F42B 6/08 473/584
5,112,063 A * 5/1992 Puckett ..... F42B 6/08 473/583
5,803,845 A * 9/1998 Anderson ..... F42B 6/08 473/583

(Continued)

*Primary Examiner* — Alexander R Niconovich

(57) ABSTRACT

The present invention is a rear-deploying broadhead with a body that is attachable to an arrow shaft. It has a body attachable to an arrow shaft, an outer housing, an inner spine, and at least two blades pivotally attached to the inner spine. The inner spine has a first end with a plunger end, and a second end which is pointed. The outer housing has a first closed end that terminates proximal to a structure for attaching the body to an arrow shaft and a second end which is open. The outer housing may also have two lateral sides with are substantially open adjacent the second end of the outer housing, and the outer housing may further have a front side and a rear side which both terminate at the second end of the outer housing with a pointed end.

7 Claims, 4 Drawing Sheets

(56) References Cited

U.S. PATENT DOCUMENTS

| | | | | |
|---|---|---|---|---|
| 7,713,151 | B2 * | 5/2010 | Fulton | F42B 6/08 473/583 |
| 7,713,152 | B1 * | 5/2010 | Tentler | F42B 6/08 473/583 |
| 7,717,814 | B1 * | 5/2010 | Sanford | F42B 6/08 473/583 |
| 8,007,382 | B1 * | 8/2011 | Sanford | F42B 6/08 473/583 |
| 8,043,177 | B2 * | 10/2011 | Flanagan | F42B 6/08 473/583 |
| 8,128,521 | B1 * | 3/2012 | Ulmer | F42B 6/08 473/583 |
| 8,393,983 | B1 * | 3/2013 | Sanford | F42B 6/08 473/583 |
| 8,496,550 | B2 * | 7/2013 | Zeren | F42B 6/08 473/583 |
| 8,894,519 | B2 * | 11/2014 | Young | F42B 6/08 473/583 |
| 8,905,874 | B2 * | 12/2014 | Sullivan | F42B 12/34 473/583 |
| 9,372,056 | B2 * | 6/2016 | Sullivan | F42B 6/08 |
| 9,470,487 | B2 * | 10/2016 | Hand | F42B 6/08 |
| 9,470,488 | B2 * | 10/2016 | Motz | F42B 6/08 |
| 9,683,819 | B2 * | 6/2017 | Buchanan | F42B 6/08 |

* cited by examiner

REAR DEPLOYING BROADHEAD

CROSS-REFERENCE TO RELATED APPLICATIONS

The present application claims the benefit under 35 USC 119(e) to U.S. Provisional Application No. 62/641,604, filed Mar. 12, 2018.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to the field of archery. More particularly, the present invention is directed to a broadhead hunting arrow in which the cutting blades are deployed from the rear position of the broadhead upon impact with the target. The deployment is affected by a piston or plunger mechanism which is disposed within the body of the broadhead. The blades of the broadhead are retracted within the body of the broadhead and retained in recesses within the body of the broadhead during the flight of the arrow. The blades deploy upon impact with the quarry.

Background of the Invention

The bow and arrow is a projectile weapon system that predates written history. The bow is a flexible arc which shoots aerodynamic projectiles called arrows. Generally, the two ends of the bow are joined together with a string such that when the string is drawn back, the ends of the bow are flexed. An arrow is placed upon the string and the string is drawn back. When the string is released, the potential energy of the flexed stick is transformed into the velocity of the arrow. Bows and arrows have historically been important weapons, but are used primarily for hunting and the sport of archery today.

An arrow generally consists of a shaft with an arrowhead attached to the front end, with fletchings and a nock at the other. Modern arrows may be made of any suitable material, including but not limited to carbon fiber, aluminum, fiberglass, and wood shafts. Carbon shafts have the advantage that they do not bend or warp, but they can often be too light weight to shoot from some bows and are expensive. Aluminum shafts are less expensive than carbon shafts, but they can bend and warp from use. Wood shafts are the least expensive option but often will not be identical in weight and size to each other and break more often than the other types of shafts.

The end of the arrow that impacts the target is the arrowhead. Historically, arrowheads have been made from various materials including flint, bone, horn, or metal. Most modern arrowheads are made of steel, but wood and other traditional materials are still used occasionally. Typically, the arrowhead is provided or manufactured separately from the arrow shaft and is attached to the arrow. For example, the arrowhead can be attached by tangs or sockets. Among arrowheads, three common types include bodkins, broadheads, and piles. Bodkin heads are simple spikes made of metal of various shapes. A broadhead arrowhead is usually triangular or leaf-shaped and has a sharpened edge or edges. Broadheads are commonly used for hunting. A pile arrowhead is a simple metal cone, either sharpened to a point or somewhat blunt, that is used mainly for target shooting.

As noted above, a broadhead is a particular type of arrow head which has outwardly extending blades that are designed to inflict more extensive damage to the animal. An objective for any broadhead is to have the animal killed as quickly as possible such that the animal will not suffer for a long period of time and so that the animal will be recoverable by the hunter. Typically, modern hunting arrows comprise a fiberglass or graphite shaft on which the broadhead body is threadably mounted.

There is a need for an improved broadhead. The flight of prior art broadheads in which the blades are secured on the orrow in a fully open position was adversely affected by wind resistance acting against the exposed broadhead blades. Accordingly, broadheads with fixed blades tend to be less accurate because of wind current deflection and tend to have less velocity because of increased drag. Modern design efforts for broadheads have focused on decreasing the wind effects to ensure a more accurate and effective broadhead. These efforts typically involve reducing the surface area of a broadhead blade to reduce the undesirable steering effects of the wind. However, by reducing the surface area of a blade, the cutting area within a target or game is also reduced, resulting in a less effective entrance and exit wound.

Conventional blade-opening arrowheads have been designed so that a substantial portion of the blade is hidden within the body of the arrowhead, such as during flight of the arrow. Upon impact, such blades are designed to open and thereby expose a cutting surface or sharp edge of the blade. When the blades of such conventional arrowheads are closed and substantially hidden within the body, the exposed, surface area is reduced and thus produces relatively less undesirable steering effects. Unfortunately, these blade-opening arrowheads are often complex mechanically and include a significant force holding the blades close. This significant force can be difficult to overcome, and these devices may fail to open reliably. Others have structural defects within the body that can result in premature opening of the blade. In either case, the arrow does not penetrate the target. Examples include U.S. Pat. Nos. 5,112,063, 4,998, 738 and 5,082,292. In these examples, the deployable cutting blades are connected by pivot features to a plunger. The cutting blades pivot between an open cutting position and a closed non-barbed position. In U.S. Pat. No. 5,102,147, a ballistic broadhead assembly has blades pivotally mounted on an actuating plunger. Upon impact, the actuating plunger thrusts the blades outwardly and forwardly.

Other broadheads which have blades partially hidden within the body use annular retaining rings, such as O-rings, wraps, bands and the like, in order to maintain the blades in a closed position during flight. Upon impact, such annular retaining rings are designed to sheer or roll back along the opening blades, in order to allow the blades to move to an open position. These conventional annular retaining rings are prone to cracking, particularly when the elastomer material dries out. Upon release of a bowstring, the rapid acceleration and thus significant opening forces move the blades in an opening direction. The conventional annular retaining rings counteract the opening forces, but fail if the ring material is brittle or damaged. Moreover, many of the annular retaining rings are designed for one use and thus must be replaced after each use. In addition to the cost involved with supplying such consumable item, the annular retaining rings are difficult and time-consuming to install, such as when hunting, particularly during inclement weather. Furthermore, the material properties of such conventional annular retaining rings can be affected by temperature changes, thereby resulting in different bias forces that cause the blade to open prematurely or to not open when desired.

Another group of mechanical broadheads deploys the blades in an over-the-top motion, such as that disclosed in U.S. Pat. No. 5,090,709. The extendable blades are pivotally connected to a body near the rear of the broadhead body. A ring releasably holds the extendable blades within corresponding slots within the body. These over-the-top broadheads often fail when the blades do not fully open until after the blades enter the target. Consequently, the full cutting diameter of an over-the-top broadhead is often not available through the depth of the target.

Other broadheads of note include the following which differ in important ways from the present invention:

U.S. Pat. No. 8,007,382 teaches an expandable arrow broadhead used for releasable attachment to one end of a hollow arrow shaft. The arrow broadhead includes a pair of two-piece, folding cutting blades pivotally attached to a side of sliding shaft housing and a tip base. The tip base is part of a sliding shaft received in a collar bore in the sliding shaft housing. The cutting blades include a front cutting blade pinned to a rear pivot arm. The front cutting blade includes an outer cutting edge and an inner edge. The cutting blades are held in a retracted position during arrow flight using a flexible band received around a portion of the cutting blades or a coil spring received around the sliding shaft and mounted in the collar bore. Upon target contact, the folding cutting blades are extended outwardly from the side of the sliding shaft housing for increased penetration in the target.

U.S. Pat. No. 9,683,819 teaches a broadhead arrowhead having fully retractable blades wherein a plunger of the tip of the arrowhead causes the blades to shear a shear pin and deploy when the arrowhead strikes a target. In an alternative embodiment, the blades are retained in the arrowhead by a friction fit that is overcome to deploy the blades when the arrowhead strikes a target.

U.S. Pat. No. 4,504,063 discloses a hunting broadhead arrow comprising a hollow body or ferrule having a plurality of circumferentially spaced slots extending through the sidewall thereof for receiving a flat substantially triangular shaped blade member in each of the slots. The shank of the point member of the arrowhead extends slidably into the interior of the body and carries a plunger member in the inner end thereof. Each blade is retained in a normal contracted or retracted position with respect to the body by suitable snap ring members, and each blade is provided with a recess on the inner edge thereof for engagement with the outer periphery of the plunger member in the retracted position of the blades. Upon impact of the arrowhead, the point member is moved in a direction toward the body for moving the plunger member rearwardly within the body whereby the trailing ends of the blades are moved radially outwardly to an extending position for the blades, thus increasing the cutting diameter of the blade upon impact to increase the efficiency of the arrowhead.

U.S. Pat. No. 7,713,152 discloses an arrowhead of the expandable or mechanical broadhead type, including a tip with a rearwardly-extending actuating member which triggers one or more blades into an open state when the tip strikes a target game animal. The blades are pivotable with respect to a body into which the actuating member extends, and they include ears against which the actuating member presses upon tip impact to trigger the blades open. A latching spring maintains the blades in a closed state until the tip and actuating member are driven rearwardly by tip impact, and the tip and actuating member are preferably maintained in a forward and ready-to-trigger state by an opening spring. The actuating member may extend between the blade ears after the blades are triggered open to fix the blades in the open state until the tip is pulled forwardly to withdraw the actuating member from the ears.

U.S. Pat. No. 7,713,151 teaches a mechanical broadhead for attachment to an arrow having a broadhead body including a plurality of blade windows formed therein, a geometrically angled retractable blade attached within each of the blade windows, retaining springs for retaining the blades in a retracted position during flight, a front body slidably mounted onto the broadhead body, and a front tip secured to the front body. Upon contact with a target, the front tip and front body slide rearwardly into an end of the geometrically angled blades, thus pushing each of the blades through the blade windows into a deployed position. The blades of the broadhead are reset by inserting a sharp point underneath an end portion of the retaining springs and applying a slight twisting motion allowing the blades to retract back into the broadhead body into a loaded position.

U.S. Pat. No. 4,579,348 discloses an archery hunting head of a tubular design having a piercing tip and plunger assembly on its frontal end, with completely enclosed rotating blades, a clutch assembly mounted internally, and a rearward extention for mounting the head to an arrow by a hot gluing method.

U.S. Pat. No. 4,932,671 discloses an expandable blade broadhead with a plurality of blades pivotally mounted on a circular ring. The ring is retained between a cap mounted on a stud extending from the front end of a ferrule, and the ferrule. A hardened steel tip is slidably mounted in a bore in the cap, and is formed with a rearwardly facing cam surface. The blades are normally held retracted in slots in the ferrule body and cap, and the tip is normally held is an extended position. When the broadhead impacts a target the tip is forced rearwardly forcing the cam surface against the blades pivoting them out of the slots to a rearwardly inclined position. To facilitate extraction the blades may pivot freely to a forwardly inclined position and the rear edges of the blades are sharpened.

U.S. Pat. No. 9,470,488 teaches a rear-deploying broadhead with a body that is attachable to an arrow shaft. The body has an inner portion and an outer cylinder, with the inner portion being disposed within the outer cylinder when the broadhead is in a nondeployed position. The inner portion has a solid internal shaft, a head, and an inner cylinder. The internal shaft is disposed in a position forward to the head of the broadhead, and is situated substantially in the center of the inner portion and movable within the inner cylinder in a plunger-like manner. The solid internal shaft terminates within the inner cylinder and is attached proximate its termination to an internal sleeve, and at least two blades are pivotally attached to the internal sleeve. The outer cylinder comprises slots there-through adapted for deployment of blades.

BRIEF SUMMARY OF THE INVENTION

It is an object of the present invention to provide a broadhead hunting arrow in which the cutting blades are deployed from the rear position of the broadhead upon impact with the target. The deployment is affected by a piston or plunger mechanism which is disposed within the body of the broadhead. The blades of the broadhead are retracted within the body of the broadhead and retained within recesses within the body of the broadhead during the flight of the arrow. The blades deploy upon impact with the quarry.

In an embodiment of the invention, the rear-deploying broadhead comprises a body attachable to an arrow shaft by any manner known in the art. In a preferred embodiment, the broadhead is threadably attached to the shaft. In a preferred embodiment, the body comprises an outer housing, an inner spine, and at least two blades pivotally attached to said inner spine, with the inner spine having a first end with a plunger end, and a second end which is pointed. The outer housing comprises a first closed end that terminates proximal to a structure for attaching the body to an arrow shaft and a second end which is open. The outer housing may also comprise two lateral sides with are substantially open adjacent the second end of the outer housing, and the outer housing may further comprise a front side and a rear side which both terminate at the second end of the outer housing with a pointed end. The inner spine may be shorter than the outer housing and substantially disposed in the center of the outer housing, with the plunger end seated snuggly but movably inside the outer housing adjacent the first end of the outer housing. In a nondeployed state, the second end of the inner spine extends slightly beyond the furthest extent of the second end of the outer housing.

This summary of the invention does not necessarily describe all features of the invention.

BRIEF DESCRIPTION OF THE DRAWINGS

Brief Description of the Several Views of the Drawings

Figure 1:
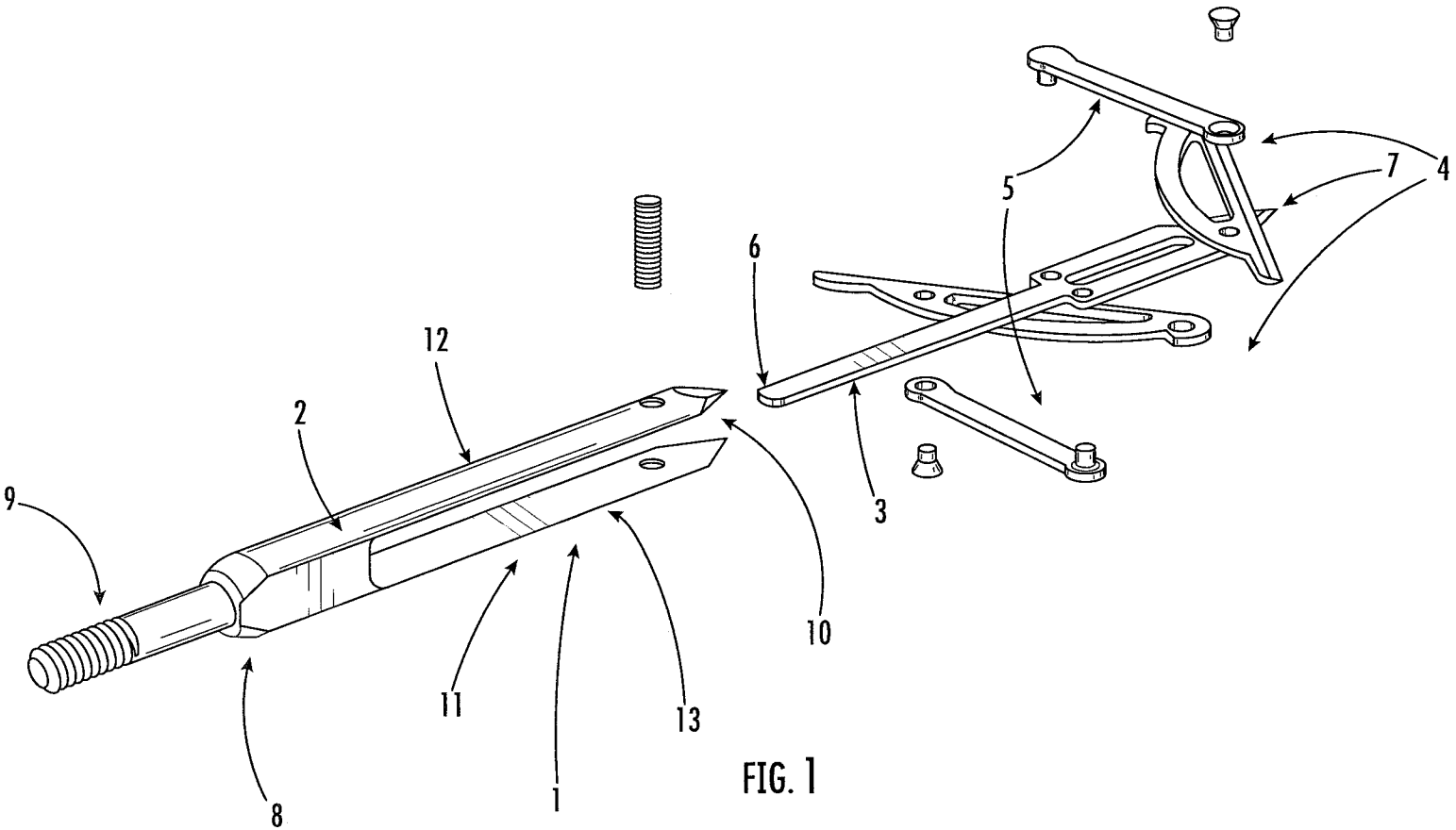

These and other features of the invention will become more apparent from the following description in which reference is made to the appended drawings wherein:

FIG. 1 is an exploded plan view of an embodiment of the invention in a deployed position.

Figure 2:
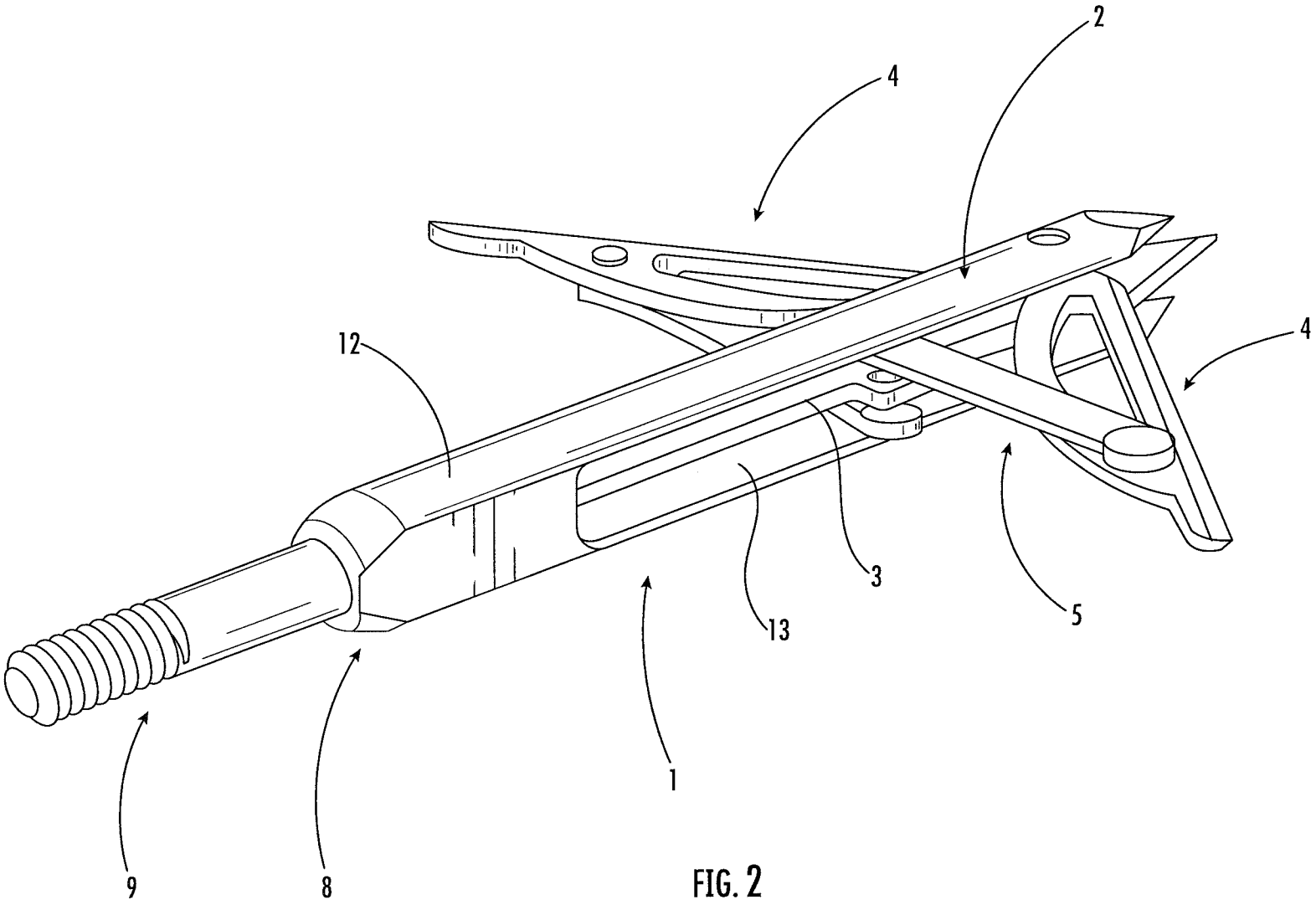

FIG. 2 is an isometric view of an embodiment of the invention in a deployed position.

Figure 3:
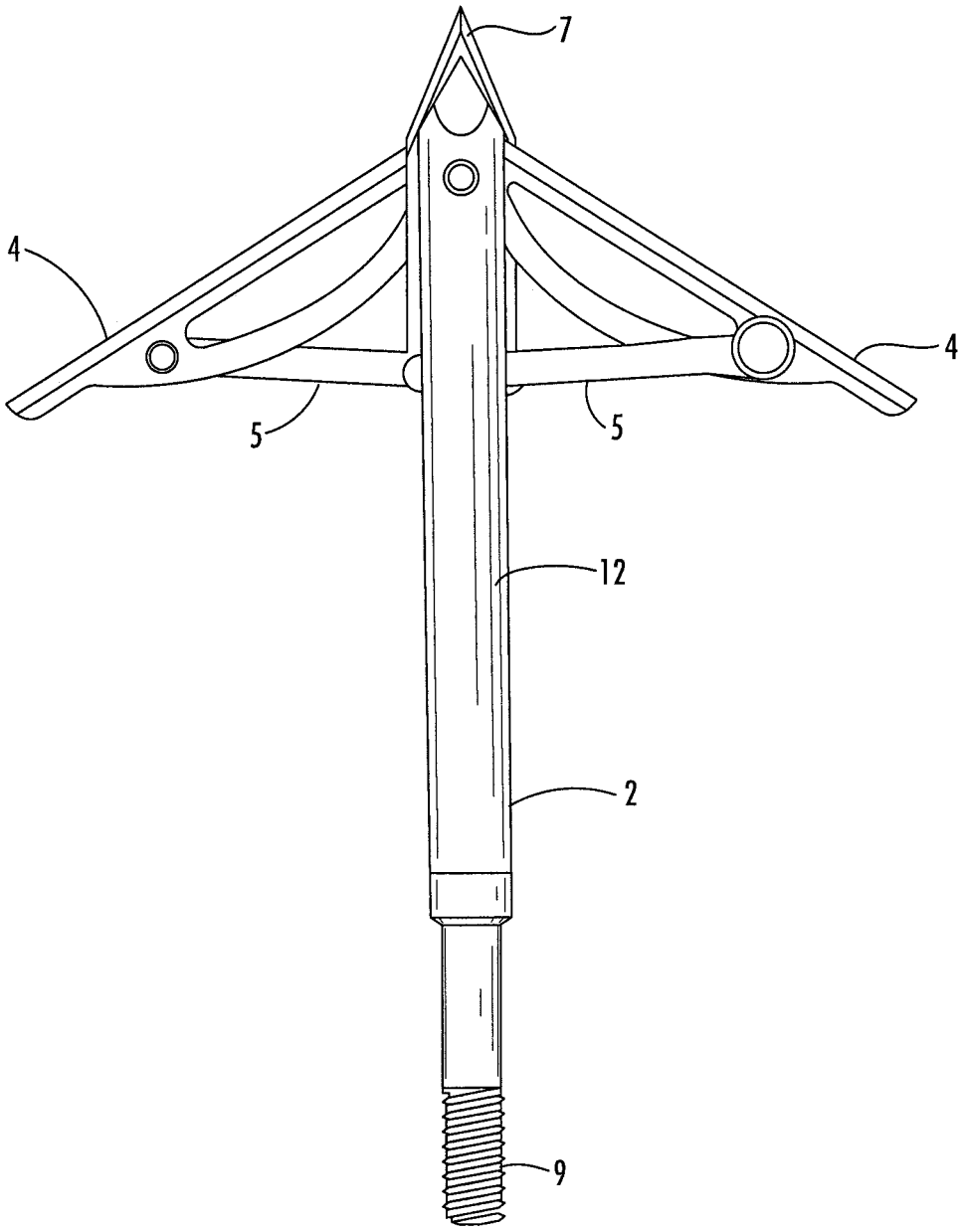

FIG. 3 is a plan view of an embodiment of the invention in a deployed position.

Figure 4:
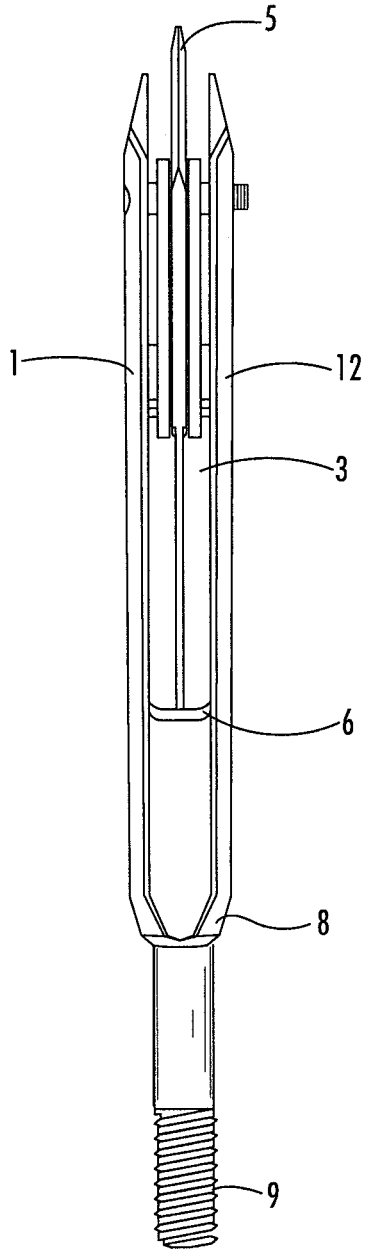

FIG. 4 is a plan view of an embodiment of the invention in a nondeployed position from a lateral perspective.

REFERENCE NUMERALS IN THE DRAWINGS

1 Body of Broadhead
2 Outer Housing
3 Inner Spine
4 Blades
5 Dog Bone Link
6 Plunger (First) End of Spine
7 Pointed (Second) End of Spine
8 Closed (First) End of Housing
9 Structure for Attachment to Arrow Shaft
10 Open (Second) End of Housing
11 Lateral Side of Housing
12 Front Side of Housing
13 Rear Side of Housing

DETAILED DESCRIPTION OF VARIOUS EMBODIMENTS OF THE INVENTION

Various embodiments of the invention are described more fully hereinafter with reference to the accompanying drawings, in which some, but not all embodiments of the invention are shown in the figures. Indeed, these inventions may be embodied in many different forms and should not be construed as limited to the embodiments set forth herein; rather, these embodiments are provided so that this disclosure will satisfy applicable legal requirements.

A first embodiment of the present invention is shown in detail in FIGS. 1-4. FIG. 1 shows an exploded plan view of an embodiment of the broadhead of the present invention in a deployed position. In this nonlimiting example, the body 1 comprises an outer housing 2. An inner spine 3 is arranged to be position inside the outer housing 2. At least two blades 4 are positioned to be pivotally attached to the inner spine 3. Each blade 4 is attached to a the inner spine 3 via a dogbone link 5 attached from an end of each blade to the inner spine 3. The inner spine has a first end 6 which acts as a plunger end. The inner spine has a second end 7 which is pointed. The outer housing 2 has a first closed end 8 that terminates proximal to a structure 9 for attaching the body to an arrow shaft. The outer housing has a second end 10 which is open. The outer housing may also comprise two lateral sides 11 with are substantially open adjacent the second end 10 of the outer housing 2. The outer housing has a front side 12 and a rear side 13 which both terminate at the second end 10 of the outer housing with a pointed end. The inner spine 3 is shorter than the outer housing 2 and substantially disposed in the center of the outer housing, with the plunger end 6 seated snuggly but movably inside the outer housing adjacent the first end of the outer housing. In a nondeployed state, the second end of the inner spine extends slightly beyond the furthest extent of the second end of the outer housing.

FIG. 2 is an isometric view of an embodiment of the invention in a deployed position. FIG. 3 is a plan view of an embodiment of the invention in a deployed position. FIG. 4 is a plan view of an embodiment of the invention in a nondeployed position from a lateral perspective.

The present invention is a rear-deploying broadhead comprising a body attachable to an arrow shaft. In a preferred embodiment, the body comprises an outer housing, an inner spine, and at least two blades pivotally attached to said inner spine. The blades may be attached to a the inner spine via a dogbone link attached from an end of each blade to the inner spine. The inner spine has a first end with a plunger end, and a second end which is pointed. The outer housing comprises a first closed end that terminates proximal to a structure for attaching the body to an arrow shaft and a second end which is open. The outer housing may also comprise two lateral sides with are substantially open adjacent the second end of the outer housing, and the outer housing may further comprise a front side and a rear side which both terminate at the second end of the outer housing with a pointed end. The inner spine may be shorter than the outer housing and substantially disposed in the center of the outer housing, with the plunger end seated snuggly but movably inside the outer housing adjacent the first end of the outer housing. In a nondeployed state, the second end of the inner spine extends slightly beyond the furthest extent of the second end of the outer housing.

In a further embodiment, the present invention is a rear-deploying broadhead which has a body with an outer housing, an inner spine, and at least two blades pivotally attached to said inner spine. The blades may be attached to the inner spine via a dogbone link attached from an end of each blade to the inner spine. The inner spine has a first end with a plunger end, and a second end which is pointed. The outer housing comprises a first closed end that terminates proximal to a structure for attaching the body to an arrow shaft and a second end which is open. The outer housing may also comprise two lateral sides with are substantially open adjacent the second end of the outer housing, and the outer housing may further comprise a front side and a rear side which both terminate at the second end of the outer housing with a pointed end. The inner spine may be shorter than the outer housing and substantially disposed in the center of the outer housing, with the plunger end seated snuggly but movably inside the outer housing adjacent the first end of the outer housing. In a nondeployed state, the second end of the inner spine extends slightly beyond the furthest extent of the second end of the outer housing, and the at least two blades pivotally attached to the inner spine are in a retracted position in the nondeployed state.

In a further embodiment, the invention comprises at least two blades that are held in the retracted position in a nondeployed state by friction, and are configured to deploy through the lateral sides of the outer housing when the movement of the inner spine commences toward the first end of the outer housing.

In a further embodiment, the invention comprises at least two blades that are each pivotally attached to the inner spine at two points on the inner spine. In a further embodiment, the at least two blades are each pivotally attached to the inner spine at least at a point approximately midway between the two ends of the inner spine. In a further embodiment, the at least two blades are each pivotally attached to the inner spine at least at a point proximal to the level of the termination of the second end of the outer housing. In a further preferred embodiment, the at least two blades are pivotally attached at two points on the inner spine, with the first attachment approximately midway between the two ends of said inner spine and the second attachment proximal to the level of the termination of the second end of the outer housing. The blades may be attached to the inner spine via a dogbone link attached from an end of each blade to the inner spine.

In another embodiment, the present invention is a rear-deploying broadhead comprising an outer housing, an inner spine, and at least two blades pivotally attached to the inner spine. The inner spine has a first end with a plunger end, and a second end distal to the plunger end. The outer housing comprises a first closed end that terminates with a structure that is attachable to an arrow shaft and a second end which is open. The outer housing also has two lateral sides with are substantially open adjacent the second end of the outer housing. The outer housing further has a front side and a rear side which both terminate at the second end of the outer housing. The inner spine is shorter than the outer housing and is substantially disposed in the center of the outer housing, with the plunger end of the inner spine seated snuggly but movably inside the outer housing adjacent the first end of said outer housing. In a nondeployed state, the second end of the inner spine extends slightly beyond the furthest extent of the second end of the outer housing. The at least two blades are pivotally attached to the inner spine and are retained in a retracted position in a nondeployed state. When the broadhead strikes a target with the extended point of the inner spine striking first, the inner spine is pushed into the outer housing toward the first end of the housing in a plunger-like manner, with the blades deploying through the openings in the lateral sides of the outer housing when the second end of the inner spine is depressed past the second ends of the front side and rear side of the outer housing.

In another embodiment, the present invention is a rear-deploying broadhead that has a body attachable to an arrow shaft. The body has an inner spine and an outer housing that has a first end proximal to the attachment to the arrow shaft and a second end. The inner spine is disposed within the outer housing when the broadhead is in a nondeployed position. The inner spine comprises a first plunger end and a second pointed end, wherein the pointed end is disposed in a position forward to the second end of the outer housing, and situated substantially in the center of the outer housing and movable within the outer housing in a plunger-like manner. The first plunger end of the inner spine is seated snuggly toward the first end of the outer housing. At least two blades are pivotally attached to the inner spine.

In a further embodiment, the present invention is a rear-deploying broadhead that has a body attachable to an arrow shaft. The body has an inner spine and an outer housing that has a first end proximal to the attachment to the arrow shaft and a second end. The broadhead comprises a structure proximal to the first end of the outer housing that is threadably attachable to an arrow shaft.

In a further embodiment, the present invention is a rear-deploying broadhead that has a body attachable to an arrow shaft. The body has an inner spine and an outer housing that has a first end proximal to the attachment to the arrow shaft and a second end. The inner spine is disposed within the outer housing when the broadhead is in a non-deployed position. The inner spine comprises a first plunger end and a second pointed end, wherein the pointed end is disposed in a position forward to the second end of the outer housing, and situated substantially in the center of the outer housing and movable within the outer housing in a plunger-like manner. The first plunger end of the inner spine is seated snuggly toward the first end of the outer housing. At least two blades are pivotally attached to the inner spine. The blades are folded inward by means of additional pivots when the broadhead is in a nondeployed position, and the blades are pivotally attached to the inner spine proximal to the level of the termination of the second end of the outer housing. In a further embodiment, the outer housing has slots therethrough adapted for deployment of blades. In another embodiment, the outer housing comprises recesses for the frictional retraction of the non-deployed blades.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed. Moreover, the terms "consisting", "comprising" and other derivatives from the term "comprise" are intended to be open-ended terms that specify the presence of any stated features, elements, steps, or components, and are not intended to preclude the presence or addition of one or more other features, elements, integers, steps, components, or groups thereof. Moreover, Applicants have endeavored in the present specification and drawings to draw attention to certain features of the invention, it should be understood that the Applicant claims protection in respect to any patentable feature or combination of features referred to in the specification or drawings. The drawings are provided to illustrate features of the invention, but the claimed invention is expressly not limited to the illustrated embodiments.

I claim:

1. A rear-deploying broadhead comprising a body attachable to an arrow shaft, said body comprising an outer housing, an inner spine, and at least two blades pivotally attached to said inner spine, wherein said inner spine has a first end with one plunger end, and a second end with a pointed end, wherein the outer housing comprises a first closed end that terminates proximal to a structure for attaching the body to an arrow shaft and a second end which is open, wherein said outer housing comprises a front side and a rear side which both extend from said first end to terminate at the second end of the outer housing with a pointed end, wherein said outer housing further comprises two lateral sides which both extend from said first end to terminate at a point proximal to said termination of said front and rear sides, wherein said housing further comprises two lateral openings extending from said termination of said two lateral sides, said two lateral openings forming a continuous opening with said open second end of said housing, wherein said inner spine is shorter than the outer housing and is substantially disposed in a center of said outer housing, with said plunger end seated snuggly but movably inside the outer housing adjacent the first end of said outer housing, wherein, in a nondeployed state, the second end of the inner spine extends slightly beyond a furthest extent of the second end of the outer housing, and the at least two blades pivotally attached to the inner spine are in a retracted position and are held in said retracted position by friction, and are configured to deploy through the lateral openings of the outer housing upon movement of the inner spine toward the first end of the outer housing.

2. The broadhead of claim 1, further comprising at least one dog bone link attaching each of said at least two blades to said inner spine.

3. The broadhead of claim 1, wherein said two blades are each pivotally attached to said inner spine at two points on the inner spine.

4. The broadhead of claim 1, wherein said two blades are each pivotally attached to said inner spine at least at a point approximately midway between the two ends of said inner spine.

5. The broadhead of claim 4, wherein said two blades are each pivotally attached to said inner spine at least at a point proximal to a level of a termination of the second end of the outer housing.

6. The broadhead of claim 4, wherein said two blades are pivotally attached at two points on the inner spine, with a first attachment approximately midway between the two ends of said inner spine and a second attachment proximal to a level of a termination of the second end of the outer housing.

7. A rear-deploying broadhead comprising an outer housing, an inner spine, and at least two blades pivotally attached to said inner spine, wherein said inner spine has a first end with a plunger end, and a second end distal to said plunger end, wherein said outer housing comprises a first closed end that terminates with a structure that is attachable to an arrow shaft and a second end which is open, wherein said outer housing comprises a front side and a rear side which both extend from said first end to terminate at the second end of the outer housing with a pointed end, wherein said outer housing further comprises two lateral sides which both extend from said first end to terminate at a point proximal to said termination of said front and rear sides, wherein said housing further comprises two lateral openings extending from said termination of said two lateral sides, said two lateral openings forming a continuous opening with said open second end of said housing, wherein said inner spine is shorter than the outer housing and is substantially disposed in a center of said outer housing, with said plunger end seated snuggly but movably inside the outer housing adjacent the first end of said outer housing, wherein, in a nondeployed state, the second end of the inner spine extends slightly beyond a furthest extent of the second end of the outer housing, wherein the at least two blades are pivotally attached to the inner spine and are retained in a retracted position in a nondeployed state, and wherein, upon said broadhead striking a target with an extended point of the inner spine striking first, said inner spine is pushed into the outer housing toward the first end of said housing in a plunging manner, with said blades deploying through the lateral openings of the outer housing when the second end of the inner spine is depressed past the second ends of the front side and rear side of the outer housing.

* * * * *